United States Patent [19]

Elders

[11] 4,407,610

[45] Oct. 4, 1983

[54] STABILIZER FOR AN EARTH STRUCTURE

[76] Inventor: Gerald W. Elders, 38 Yakashba Estates, Prescott, Ariz. 86301

[21] Appl. No.: 341,067

[22] Filed: Jan. 20, 1982

Related U.S. Application Data

[63] Continuation-in-part of Ser. No. 134,939, Mar. 28, 1980, Pat. No. 4,350,462.

[51] Int. Cl.[3] ..... E21D 21/00; E21D 20/00

[52] U.S. Cl. ..... 405/259; 411/60; 411/521

[58] Field of Search ..... 405/259–261, 405/255, 244; 411/57, 60, 62, 15

[56] References Cited

U.S. PATENT DOCUMENTS 4,126,004 11/1978 Lindeboom ..... 405/259
4,260,294 4/1981 Cantrel ..... 405/259

FOREIGN PATENT DOCUMENTS 86626 5/1896 Fed. Rep. of Germany ..... 405/255
13528 of 1900 United Kingdom ..... 405/255

*Primary Examiner*—Dennis L. Taylor
*Attorney, Agent, or Firm*—Cohn, Powell & Hind

[57] ABSTRACT

The stabilizer comprises an elongate support tube having a split extending generally lengthwise responsive to peripheral compression of the tube to cause contraction of cross-sectional dimension and cause frictional engagement with the surface of a bore in an earth structure for anchoring the tube within the bore. A sleeve located about and fixed to the driven end of the tube provides an impact surface for accepting insertion forces for driving the tube into the bore. A support plate having a hole with cross-sectional dimensions smaller than the cross-sectional dimensions of the bore is positioned relative to the earth structure with the hole substantially aligned with the opening of the bore. The plate hole compresses the tube upon insertion of the tube into the bore through the plate hole, the tube expanding after passage through the plate hole to frictionally engage the surface of the bore in spaced relation to the bore opening.

7 Claims, 6 Drawing Figures

STABILIZER FOR AN EARTH STRUCTURE

CROSS-REFERENCE TO RELATED APPLICATION

This application is a continuation-in-part of copending application Ser. No. 134,939 filed Mar. 28, 1980 for "Roof Support Pin" now U.S. Pat. No. 4,350,462.

BACKGROUND OF THE INVENTION

This invention relates generally to improvements in a stabilizer for an earth structure, and more particularly to an improved stabilizer of the type employing a compressible tube for engagement with the surface of a bore formed in the earth structure.

The prior art teaches the use of a compressible tube for roof support, and teaches the use of the bore to compress the tube. A tube is forced into an undersized bore where it frictionally engages the surface of the bore to anchor itself.

In coal mines, it is generally necessary to leave a roof layer of top coal or shale through which a roof support pin must be mounted. This roof layer of top coal is quite fragile, and the force exerted on it by a tube being inserted into an undersize bore could result in the fracturing of the top coal, thereby causing it to either fall or create a very dangerous condition. It is therefore important that the bore opening not be used to compress a tube.

The stabilizer disclosed by U.S. Pat. No. 3,349,567 discloses the insertion of a stabilizer into an oversized bore and expanded into engagement with the surface of the bore. The stabilizers disclosed in U.S. Pat. Nos. 3,922,867 and 4,012,913 have tubes which are longitudinally slit so as to yield under circumferential compression to accommodate a forced insertion into an undersized bore. The slit stabilizers have a tendancy to fail when forceably inserted into a structure bore by a stabilizer driver, such driver normally being impacted by a piston. The slit, provided to accommodate a reduction of the cross-sectional dimension of the tube, opens up and the driven end of the tube bends and becomes splayed.

In U.S. Pat. No. 4,126,004, a wire rod is attached at the driven end of the tube so that the terminal surface and the wire rod provide an impact surface for accepting the impact forces. However, because of the structure of the wire rod, there is a considerable space between the terminal surface and the impact surface of the wire rod, whereby the terminal surface of the tube mushrooms upon initial impact forces until it substantially closes the gap and moves outwardly against the wire rod. This "mushrooming effect" adversely effects the distribution of the impact forces applied to the tube.

SUMMARY OF THE INVENTION

The present invention overcomes the above described difficulties and disadvantages in that the stabilizer provides a compressible tube which does not rely on the bore opening to compress the tube, and which does not frictionally engage a bore immediately adjacent to the bore opening. Moreover, means is made integral with the driven end of the tube for reinforcing the driven end to accept impact insertion forces for most effective distribution to the tube, and to preclude any mushrooming or opening-up of the tube slit. Further, such means is relatively disposed with respect to the driven end of the split tube without any regard to the location of the slit.

The present stabilizer includes an elongate support tube having means extending generally lengthwise responsive to peripheral compression of the tube to cause a contraction of cross-section dimension, and causing an expansion of cross-sectional dimension upon diminishment of peripheral compression for frictional engagement with the surface of a bore provided in the earth structure for anchoring the tube within the bore. A sleeve is located about and fixed to the driven end of the tube, the sleeve providing an impact surface for accepting insertion forces for driving the tube into the bore.

In one aspect of the invention, the driven end of the tube includes a terminal surface located and disposed relative to the sleeve so that the terminal surface and sleeve provides a combined substantially continuous impact surface for accepting the insertion forces.

In another aspect of the invention, the sleeve includes a bottom wall, a portion of which underlies and engages the terminal surface of the tube, the bottom wall providing the impact surface for accepting the insertion forces.

In still another aspect of the invention, the sleeve includes projections extending inwardly of the tube, and extending under and in engagement with the terminal surface of the tube, the projections providing the impact surface for accepting the insertion forces, and providing means for attaching a hanger on the sleeve.

In another aspect of the invention, the sleeve includes a bottom wall completely enclosing the driven end of the tube, and extending under and in engagement with the terminal surface of the tube, the bottom wall providing the impact surface for accepting the insertion forces.

In another aspect of the invention, the driven end of the tube is peripherally compressed by the sleeve.

In another aspect of the invention, the stabilizer includes a support plate having a hole with cross-sectional dimensions smaller than the cross-sectional dimensions of the bore, the plate being positioned relative to the earth structure with the hole substantially aligned with the opening of the bore. The elongate support tube includes means extending generally lengthwise responsive to peripheral compression of the tube to cause a contraction of cross-sectional dimension, and causing an expansion of cross-sectional dimension upon diminishment of peripheral compression. The plate hole compresses the tube upon insertion of the tube into the bore through the plate hole, the tube expanding after passage through the plate hole to frictionally engage the surface of the bore in spaced relation to the bore opening for anchoring the tube within the bore. The sleeve has internal cross-sectional dimensions of approximately or less than that of the plate hole. The driven end of the tube is located in and fixed to the sleeve.

DESCRIPTION OF THE PREFERRED EMBODIMENT

Figure 1:
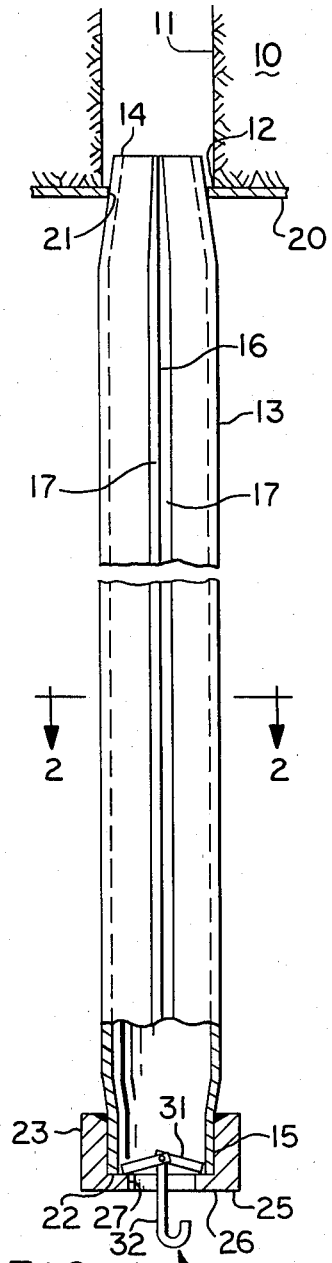
FIG. 1 is a side elevational view of the stabilizer and the bore in the earth structure upon initial insertion.
Figure 2:
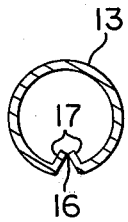
FIG. 2 is a cross-sectional view taken on line 2—2 of FIG. 1.
Figure 3:
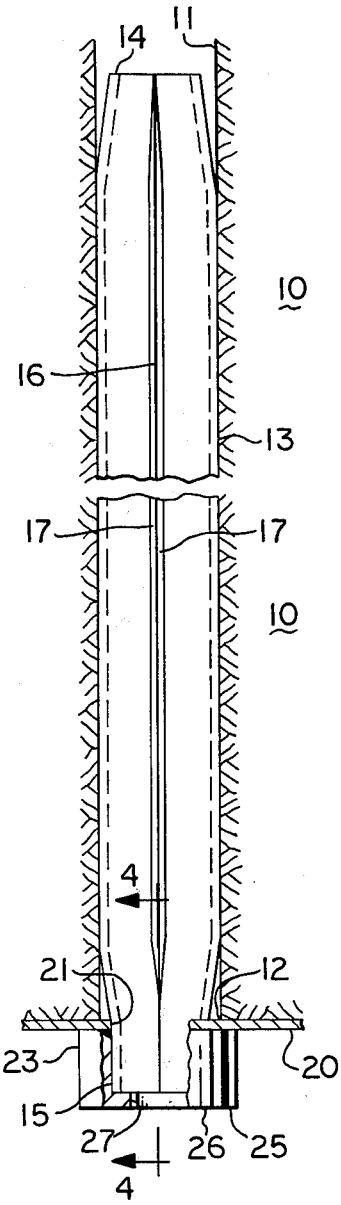
FIG. 3 is a side elevational view, partly in cross-section, illustrating the stabilizer with the elongate support tube completely inserted.
Figure 4:
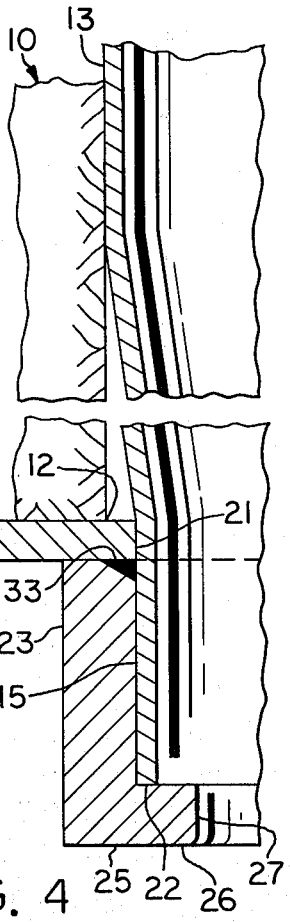
FIG. 4 is an enlarged, fragmentary cross-sectional view as taken on line 4—4 of FIG. 3.

Referring now by characters of reference to the drawing, and first to FIGS. 1, 3 and 4, it will be understood that the earth structure 10, which may be the roof or wall of a mine shaft or tunnel, includes a bore 11 having an opening 12.

The stabilizer includes an elongate support tube 13 having a tapered leading end 14 and a trailing driven end 15.

Means such as a longitudinal slit 16 extends generally lengthwise along the tube 13 responsive to peripheral compression of the tube 13 to cause a contraction of cross-sectional dimension, and causing an expansion of cross-sectional dimension upon diminishment of peripheral compression. The longitudinal slit 16 is formed by adjacent longitudinal edges 17 that engage and turn inwardly as the tube 13 is peripherally or circumferentially resiliently compressed.

A support plate 20 includes a hole 21 with cross-sectional dimensions smaller than the cross-sectional dimensions of the bore 11. The plate 20 is positioned relative to the earth structure 10 with the hole 21 substantially aligned with the opening 12 of the bore 11.

As the tube 13 is inserted into the bore 11 through the plate hole 21, the surface defining the plate hole 21 compresses the tube 13. After passage of the tube 13 through the plate hole 21, the tube 13 expands to frictionally engage the surface of the bore 11 in spaced relation to the bore opening 12 for anchoring the tube 13 within the bore 11.

The driven end 15 of the tube 13 is provided with a terminal surface 22.

A sleeve 23 is provided having internal cross-sectional dimensions approximately or less than that of the plate hole 21. The driven end 15 of the tube 13 is located in and fixed to the sleeve 23. The sleeve 23 provides an impact surface for accepting insertion forces for driving the tube 11 through the plate hole 21 and into the bore 11. Preferably, the sleeve 23 extends completely about the drive tube end 15.

Figure 5:
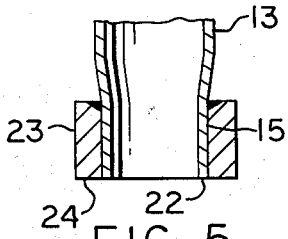
FIG. 5 is a fragmentary cross-sectional view illustrating a modified sleeve construction.

As is best shown in FIG. 5, the driven end 15 of tube 13 and the sleeve 23 provide a combined substantially continuous impact surface 24 for accepting the insertion forces.

As shown in FIGS. 1, 3, 4 and 6, the sleeve 23 includes a bottom wall 25, a portion of which underlies and engages the terminal surface 22 of tube 13. The bottom wall 25 provides an impact surface 26 for accepting the insertion forces.

From FIGS. 1, 3 and 4, it will be understood that the sleeve 23 includes projections 27 extending inwardly of the tube 13, and extending under and in engagement with the terminal surface 22 of the tube 13. The projections 27 provide the impact surface for accepting the insertion forces, and providing means for attaching a hanger 30 on the sleeve 23.

The hanger 30 can be of any conventional type. For example, the hanger 30 can includes spring-loaded toggle arms 31 pivotally mounted to a hook 32. The shank of hook 32 and the toggle arms 31 are inserted upwardly into the driven end 15 of tube 13 through the lower sleeve opening provided between the sleeve projections 27. When the toggle arms 31 are located above the projections 27, the toggle arms 31 will expand automatically outward and will engage the upper surface of the projections 27 to hold the hook 32 of the hanger 30 securely in place.

Figure 6:
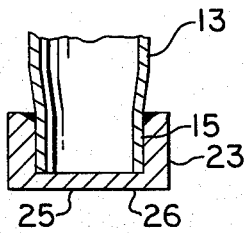
FIG. 6 is a fragmentary cross-sectional view illustrating still another modification of a sleeve construction.

As shown in FIG. 6, the sleeve 23 includes a bottom wall 25 that completely encloses the driven end 15 of the tube 13, and extends under and in engagement with the terminal surface 22 of the tube 13. The bottom wall 25 provides the impact surface for accepting the insertion forces.

In each of the species illustrated, the driven end 15 of tube 13 is peripherally compressed and then inserted into the sleeve 23. When such compression is released, the driven end 15 expands outwardly into gripping relation with the sleeve 23. Because the internal dimensions of sleeve 23 are less than the expanded, uncompressed dimensions of tube 13, the sleeve 23 will hold the driven end 15 under compression so that the driven end 15 has external dimensions less than the uncompressed, external dimensions of tube 13.

To provide a positive connection between sleeve 23 and the driven end 15 of tube 13, the sleeve 23 and driven end 15 are welded together as indicated by the weld 33. As the tube 13 is driven into the bore 11 through the plate hole 21, the upper surface of sleeve 23 will engage the lower surface of plate 20. Because the internal dimensions of the sleeve 23, and the external dimensions of the driven tube end 15 are approximately or less than the dimensions of the plate hole 21, the integrity of the weld 33 is maintained as the upper surface of sleeve 23 and weld 33 approach and engage the plate 20 when driven by impact forces.

It will be understood that the sleeve 23 can be fixed to the driven tube end 15 by inertia welding or by furnace brazing or by any other conventional method.

It is thought that the structural arrangement and usage of the stabilizer has become fully apparent from the foregoing detailed description of parts and enviroment, but for completeness of disclosure, the insertion of the tube will be described briefly.

First, it will be assumed that the plate 20 is located against the earth structure 10 with the plate hole 21 substantially aligned with the opening 12 of bore 11. Then the tapered leading end 14 of the tube 13 is located in the plate hole 21, and impact forces are applied to the lower end of the sleeve 23 and driven tube end 15. In FIG. 5, the impact forces are applied to the combined continuous impact surface 24. In FIGS. 1, 3 and 4, the impact forces are applied to the impact surface 26 of the bottom sleeve wall 25. In FIG. 6, the impact forces are applied to the impact surface 26 comprising the complete bottom sleeve wall 25.

As the tube 13 is moved upwardly through the plate hole 21 and into the bore 11, the plate surface defining the plate hole 21 peripherally compresses the tube 13 to a reduced cross-sectional dimension. After the compressed tube 13 passes through the plate hole 21, the compression forces are diminished, and the tube 13 expands laterally outwardly into frictional engagement with the surface defining the bore 11. However, the frictional engagement of the tube 13 with the bore 11 upon expansion does not take place at the entrance portion of the bore 11, but rather engages the surface of bore 11 in considerably spaced relation to the bore opening 12. The entrance to the bore opening 12 is not utilized to compress the tube 13 during insertion in order to preclude any fracturing of the top layer of the earth structure 10 which might otherwise create a very dangerous condition.

When fully inserted, the upper surface of the sleeve 23 engages the plate 20, and holds the plate 20 securely in place against the earth structure. The plate 20 also tends to support the top layer of the earth structure 10 immediately adjacent of the bore opening 12 to preclude any fracturing of such layer.

Because of the substantially continuous impact surface provided, the insertion forces are more effectively distributed to the tube. In FIG. 5, the bottom of sleeve 23 and the terminal surface 22 of tube 13 provide such an impact surface 24. In FIGS. 1, 3 and 4, the bottom wall 25 of sleeve 23, including the projections 27, provide this impact surface 26. In FIG. 6, the complete bottom wall 25 of sleeve 23 provide this advantageous impact surface 26.

Further, because the sleeve 23 completely embraces the driven end 15, and maintains such driven end 15 under compression with the slot 16 closed, there is no possibility of the split driven tube end 15 opening during insertion under impact blows. Also, the sleeve 23 can receive the driven tube end 15 without any consideration of the relative disposition of the slit 16 with respect to any portion of the surrounding sleeve 23.

I claim as my invention:

1. A stabilizer for an earth structure having a bore with an opening, comprising:

(a) a support plate having a hole with cross-sectional dimensions smaller than the cross-sectional dimensions of the bore, the plate being positioned relative to the earth structure with the hole substantially aligned with the opening of the bore, (b) an elongate support tube including:

1. means extending generally lengthwise responsive to peripheral compression of the tube to cause a contraction of cross-sectional dimension, and causing an expansion of cross-sectional dimension upon diminishment of peripheral compression, the plate hole compressing the tube upon insertion of the tube into the bore through the plate hole, and the tube expanding after passage through the plate hole to frictionally engage the surface of the bore in spaced relation to the bore opening for anchoring the tube within the bore, and 2. a driven end, and (c) a sleeve having internal cross-section dimensions approximately or less than that of the plate hole, the driven end of the tube being located in and fixed to the sleeve, the sleeve providing an impact surface for accepting insertion forces for driving the tube through the plate hole and into the bore.

2. A stabilizer as defined in claim 1, in which:

(d) the driven end of the tube includes a terminal surface, the terminal surface and the sleeve providing a combined substantially continuous impact surface for accepting the insertion forces.

3. A stabilizer as defined in claim 1, in which:

(d) the driven end of the tube includes a terminal surface, and (e) the sleeve includes a bottom wall, a portion of which underlies and engages the terminal surface of the tube, the bottom wall providing the impact surface for accepting the insertion forces.

4. A stabilizer as defined in claim 1, in which:

(d) the driven end of the tube includes a terminal surface, and (e) the sleeve includes projections extending inwardly of the tube, and extending under and in engagement with the terminal surface of the tube, the projections providing the impact surface for accepting the insertion forces.

5. A stabilizer as defined in claim 4, in which:

(f) a hanger located in the driven end, and attached to the projections and extending through the sleeve.

6. A stabilizer as defined in claim 1, in which:

(d) the driven end of the tube includes a terminal surface, and (e) the sleeve includes a bottom wall completely enclosing the driven end of the tube, and extending under and in engagement with the terminal surface of the tube, the bottom wall providing the impact surface for accepting the insertion forces.

7. A stabilizer as defined in claim 1, in which:

(d) the driven end of the tube is peripherally compressed by and attached to the sleeve.

* * * * *